US008512803B2

(12) United States Patent
Hatano et al.

(10) Patent No.: US 8,512,803 B2
(45) Date of Patent: Aug. 20, 2013

(54) GLUING METHOD AND DEVICE OF CORRUGATED BOARD SHEET

(75) Inventors: Osamu Hatano, Hiroshima (JP); Kazuya Sugimoto, Hiroshima (JP)

(73) Assignee: Mitsubishi Heavy Industries Printing & Packaging Machinery, Ltd., Tokyo (JP)

( * ) Notice: Subject to any disclaimer, the term of this patent is extended or adjusted under 35 U.S.C. 154(b) by 284 days.

(21) Appl. No.: 12/990,500

(22) PCT Filed: Aug. 18, 2009

(86) PCT No.: PCT/JP2009/064461

§ 371 (c)(1), (2), (4) Date: Nov. 19, 2010

(87) PCT Pub. No.: WO2010/024156

PCT Pub. Date: Mar. 4, 2010

(65) Prior Publication Data

US 2011/0052814 A1 Mar. 3, 2011

(30) Foreign Application Priority Data

Aug. 27, 2008 (JP) ..... 2008-218075

(51) Int. Cl.
*B05D 1/26* (2006.01)
*B05D 5/10* (2006.01)
*B31B 1/62* (2006.01)

(52) U.S. Cl.
USPC ..... 427/208.6; 427/207.1; 427/285; 118/253; 118/679

(58) Field of Classification Search
USPC ..... 427/208.6, 207.1, 285; 118/253, 118/679
See application file for complete search history.

(56) References Cited

U.S. PATENT DOCUMENTS

| | | | | |
|---|---|---|---|---|
| 5,876,502 | A | 3/1999 | Sugimura et al. | |
| 6,068,701 | A * | 5/2000 | Kohler et al. | 118/249 |
| 2006/0081727 | A1 * | 4/2006 | Stepaniak et al. | 239/592 |

FOREIGN PATENT DOCUMENTS

| | | | |
|---|---|---|---|
| JP | 3-133719 | A | 6/1991 |
| JP | 8224854 | A | 9/1996 |
| JP | 10-156974 | A | 6/1998 |
| JP | 10-211664 | A | 8/1998 |
| JP | 2000-334351 | A | 12/2000 |
| JP | 2001-30380 | A | 2/2001 |
| JP | 2003-154583 | A | 5/2003 |

OTHER PUBLICATIONS

International Search Report of Application No. PCT/JP2009/064461 mailed Oct. 13, 2009.
KR Office Action, dated Aug. 31, 2012, issued in KR Application No. 2010-7024387.
Notice of Rejection as mailed on Mar. 12, 2013 in corresponding Japanese Patent Application No. 2008-218075 with English Translation.

* cited by examiner

*Primary Examiner* — Frederick Parker
(74) *Attorney, Agent, or Firm* — Kanesaka Berner & Partners, LLP

(57) ABSTRACT

A method of applying glue to a gluing margin of the corrugated board sheet includes the steps of: applying pressure on the glue gun by a first pressure device to compensate self-weight of the glue gun; detecting a reaction force of the gluing margin by a reaction-force sensor on a downstream side of a slotter creaser arranged on an upstream side of the glue gun, the gluing margin being compressed in the slotter creaser; and applying pressure on the gluing margin by a second pressure device, the pressure to be applied by the second pressure device being set in accordance with a detection value of the reaction-force sensor.

4 Claims, 6 Drawing Sheets

GLUING METHOD AND DEVICE OF CORRUGATED BOARD SHEET

RELATED APPLICATIONS

The present application is based on International Application Number PCT/JP2009/064461, filed Aug. 18, 2009, and claims priority from Japanese Application Number 2008-218075, filed Aug. 27, 2008, the disclosures of which are hereby incorporated by reference herein in their entirety.

BACKGROUND OF THE INVENTION

1. Technical Field

The present invention relates to a gluing method and device for applying glue to a corrugated board sheet in a gluing process in a box-producing apparatus which produces a box of a corrugated board sheet manufactured by a corrugator, in which a gluing defect of a gluing area is eliminated and the glue is firmly applied to the gluing area.

2. Background Art

A corrugated board sheet manufactured by a corrugator is processed for printing, making creasing lines and slotting on a conveyance line of the box-producing machine, and then formed into a square tube in a gluing step and a folding step in which a gluing margin of one panel of four-panel box is overlapped and glued to a join flap of the opposite panel so as to form a body in a shape of a square tube, and flaps extending from each panel form a bottom part and a top part of the box.

FIG. 5 illustrates a general structure of a box production line of the corrugated board box. In FIG. 5, the box production line starts from the right-hand side and the corrugated board sheet S is conveyed in a direction of arrow a so as to conduct the box-producing process. On the upstream side of the box-producing process, front and back linerboards and a corrugated board sheet S of a corrugating medium to be interposed between the linerboards, are produced and stacked in a paper supply part A. The corrugated board sheet S shown in FIG. 5 has already been cut into predetermined sizes in width and length directions in the corrugator line and a creasing line b is made in a length direction thereof.

In the paper supply part A, the corrugated board sheets S are positioned in the same direction and stacked so as to form a group $G_1$ of the corrugated board boxes. The corrugated board sheet S of the bottom of the supply part is fed individually from the supply part A to a flexo-printing machine B in which four colors in total (at least two ink colors) are printed on the corrugated board sheet S one color at a time, and the printed corrugated board sheet S is transferred to a slotter•creaser C which performs the steps of making creasing lines and slotting in a plurality of places on the corrugated board sheet S in a traveling direction (four places in FIG. 5) so as to form creasing lines c and slots d parallel to the short end of the sheet S and a gluing margin f.

Subsequently, a hole-making step is performed by a die-cut unit D, and the gluing margin f is applied glue and folded in a folding unit D so as to attach the gluing margin f to the panel e, thereby forming a square-tube shaped corrugated board box W. Next, the corrugated board box W in a flat state is transferred to a counter ejector F in which the number of sheets is counted and stacked in the same direction so as to make a group $G_2$ of the corrugated board boxes. Finally, the corrugated board box group $G_2$ is transferred to a binding machine located in a downstream side of the counter ejector F in the transferring direction by a transferring conveyor so as to bundle the corrugated board boxes ready for shipment.

In FIG. 5, a gluing device 010 for applying glue to the gluing margin f of the corrugated board sheet S is arranged in an immediate downstream side of the die-cut unit D. A conventional gluing device 010 is illustrated in FIG. 6, in which the corrugated board sheet S is fed into a pair of guide bars 011 so as to space out the cut cardboard sheets S for the gluing step. The guide bar 011 has a glue gun 012 at an end thereof. Glue g is supplied to the glue gun 012 and a plurality of nozzles not shown in the drawing are arranged at a tip thereof. In an upstream side of the glue gun 012, a glue-timing sensor 013 is provided.

The glue gun 012 houses a solenoid valve and is constructed such that, the glue is ejected from the glue gun by sending electricity to the solenoid valve. When the corrugated board sheet S passes the glue-timing sensor 013, the glue-timing sensor 013 detects the passing of the corrugated board sheet S and the solenoid valve of the glue gun operates in accordance with the gluing timing at which the corrugated board sheet S passes the glue gun 012 and plural lines of glue g are applied on the gluing margin f from the nozzles.

Patent Document 1 discloses a gluing device which can directly detect the gluing margin without causing a malfunction of the detection device detecting the front and rear ends of the corrugated board sheet so that the glue setting can be easily changed in a short period of time depending on an order change of the corrugated board sheet. As a result, the productivity of a box manufacturing machine can be improved.

Related Patent Document

[Patent Document]

[Patent Document 1] JP10-156974A published in 1999.

SUMMARY OF THE INVENTION

The glue gun may be a contact-type whose nozzles come in contact with the gluing margin when applying the glue, or a non contact-type whose nozzles do not touch the gluing margin. With the gluing device of a contact-type, there is an advantage that the glue can be firmly applied to the gluing area of the gluing margin compared to a non contact-type.

However, with the glue gun of the contact-type, when the nozzles touch the gluing margin of the corrugated board sheet, there is a resistance force working against the traveling of the corrugated board sheet. Thus, when the resistance force becomes significant, a tilt or misalignment of the corrugated board sheet may occur.

To solve the problem, the conventional gluing device having the glue gun of a contact-type adopts a means to reduce the resistance force. Specifically, an air cylinder is provided for applying pressure in a direction opposite to the self-weight of the gluing device, by which the self-weight of the gluing device loaded on the corrugated board sheet is compensated and the excessive contact pressure on the corrugated board sheet by the self-weight of the glue gun is prevented. Further, the air cylinder houses a spring that applies elastic force in the direction to help the glue gun come back immediately in response to an impact when the glue gun touches the gluing margin.

Therefore, depending on a paper type of the corrugated board sheet, such as a material, a flute pattern, basic weight and a paper thickness, the elastic force of the spring being applied to the glue gun changes. Thus, the amount of the glue being applied on the gluing margin becomes unstable and as a result the gluing margin receives excessive contact pressure, thereby causing tilt or misalignment of the corrugated board sheet.

In view of the problems above, one object of the present invention is that, in the gluing process of the box production line using the glue gun of a contact-type, a stable gluing is always achieved without the gluing margin receiving the excessive contact pressure even when the order of the corrugated board sheet changes.

Means to Solve the Problems

To achieve the above object, the present invention provides a gluing method of applying glue to a gluing area in a gluing margin of a joint flap of a corrugated board sheet traveling on a box production line by a glue gun of a contact-type in a gluing process, the method comprising the steps of: applying pressure on the glue gun by a first pressure device in a direction that compensates self-weight of the glue gun on the corrugated board sheet during the gluing process; detecting a reaction force of the gluing margin by a reaction-force sensor which is arranged in a transfer line of the corrugated board sheet on an upstream side of the glue gun in a traveling direction of the corrugated board sheet; and applying pressure on the gluing margin of the corrugated board sheet by a second pressure device arranged in a proximity of a gluing point at which the glue is applied during the gluing process, the pressure to be applied by the second pressure device being set in accordance with a detection value of the reaction-force sensor.

With the method of the present invention, the pressure is applied by the first pressure device in the direction that compensates the self-weight of the glue gun so as to minimize the contact pressure on the gluing margin by the glue gun during the gluing process.

Next, the reaction-force sensor is arranged in a transfer line of the corrugated board sheet on an upstream side of the glue gun in the traveling is brought in contact with the corrugated sheet so as to detect the reaction force of the corrugated board sheet, and the paper type or the thickness of the corrugated board sheet is determined based on the detection value. Subsequently, the second pressure device arranged in proximity of the gluing point applies the pressure that is optimal for the determined paper type on the corrugated board sheet in accordance with the detection value of the reaction-force sensor.

As a result, only a small mount of contact pressure is loaded on the corrugated board sheet by the glue gun during the gluing process and the pressure that is optimal for the paper type is applied on the corrugated board sheet by the second pressure device so that there is no tile of the corrugated board sheet during the gluing process and the glue can be applied firmly on the corrugated board sheet.

It is preferable that the reaction-force sensor is arranged on a downstream side of the steps of making a creasing line and slotting in a box-manufacturing process so as to detect the reaction force of the join flap whose thickness has been reduced. The gluing area becomes thick by the amount corresponding to the gluing margin. Thus, in the box producing process, the gluing margin and the join flap of the opposite panel to which the gluing margin is attached are compressed so as to reduce the thickness thereof while performing the steps of making a creasing line and slotting in the box-manufacturing.

As the thickness of the gluing margin to be glued cannot be determined before the compressing of the gluing margin and the join flap, the reaction-force sensor is arranged on a downstream side of steps of making a creasing line and slotting so as to detect the thickness of the gluing margin. If the reaction-force sensor is arranged on a downstream side of the die-cut unit, the reaction force may not be detected precisely as the corrugated board sheet is supported only at two points instead of across the whole width of thereof. Thus, it is preferable to provide the reaction-force sensor in the location that is between the steps of making a creasing line and slotting and the die-cut unit.

The present invention also provides a gluing device of applying glue to a gluing area in a gluing margin of a joint flap of a corrugated board sheet traveling on a box production line by a glue gun of a contact-type, the device comprising: a first pressure device which applies pressure on the glue gun in a direction that compensates self-weight of the glue gun; a reaction-force sensor which detects a reaction force of the gluing margin by coming in contact with the corrugated board sheet, the reaction-force sensor being arranged on an upstream side of the glue gun in the traveling direction; and a second pressure device which is arranged in a proximity of a gluing point at which the glue is applied and applies pressure on the gluing margin of the corrugated board sheet when the glue is applied thereto, the pressure to be applied being set in accordance with a detection value of the reaction-force sensor.

With the device of the present invention, it is preferable that each of the first and second pressure devices includes an air cylinder. The air cylinder is capable of resiliently absorbing the reaction force from the gluing margin by the compressibility of the air of the air cylinder, and thus the gluing margin does not receive a strong impact. As a result, the gluing margin does not get damaged.

It is also preferable that the gluing device of the present invention further comprises a guide member having a pair of guide plates which are arranged in an immediate upstream side of the glue gun and interpose a transfer path of the corrugated board sheet therebetween so as to form the transfer path into a taper shape, wherein an end terminal of the second pressure device is connected to one of the guide plates and the pressure is applied on the gluing margin of the corrugated board sheet via one of the guide plates of the guide member by the second pressure device.

With this structure, the pressure by the second pressure device can be firmly applied to the gluing margin and also pressure is applied to the gluing margin via the guide member which forms the transfer path into the taper shape so that the impact on the gluing margin is eased and further no damage is caused on the gluing margin.

Effect Of The Present Invention

According to the present invention, the gluing method of applying glue to a gluing area in a gluing margin of a joint flap of a corrugated board sheet traveling on a box production line by a glue gun of a contact-type in a gluing process, comprises the steps of: applying pressure on the glue gun by a first pressure device in a direction that compensates self-weight of the glue gun on the corrugated board sheet during the gluing process; detecting a reaction force of the gluing margin by a reaction-force sensor which is arranged in a transfer line of the corrugated board sheet on an upstream side of the glue gun in a traveling direction of the corrugated board sheet; and applying pressure on the gluing margin of the corrugated board sheet by a second pressure device arranged in a proximity of a gluing point at which the glue is applied during the gluing process, the pressure to be applied by the second pressure device being set in accordance with a detection value of the reaction-force sensor. As a result, the gluing margin can be glued while the optimal pressure is applied during the gluing step depending on the paper type of the corrugated board sheet, thereby causing no tilt or misalignment of the corrugated board sheet in the traveling direction thereof and also achieving the gluing of the gluing margin in a stable manner.

According to the present invention, the gluing device of applying glue to a gluing area in a gluing margin of a joint flap of a corrugated board sheet traveling on a box production line by a glue gun of a contact-type, comprises: a first pressure device which applies pressure on the glue gun in a direction that compensates self-weight of the glue gun; a reaction-force sensor which detects a reaction force of the gluing margin by coming in contact with the corrugated board sheet, the reaction-force sensor being arranged in a transfer line of the corrugated board sheet on an upstream side of the glue gun in the traveling direction; and a second pressure device which is arranged in a proximity of a gluing point at which the glue is applied and applies pressure on the gluing margin of the corrugated board sheet when the glue is applied thereto, the pressure to be applied being set in accordance with a detection value of the reaction-force sensor. As a result, the working effects similar to those obtained by the above method can be obtained.

DETAILED DESCRIPTION OF THE INVENTION

A preferred embodiment of the present invention will now be described in detail with reference to the accompanying drawings. It is intended, however, that unless particularly specified, dimensions, materials, shape, its relative portions and the like shall be interpreted as illustrative only and not limitative of the scope of the present invention.

Figure 1:
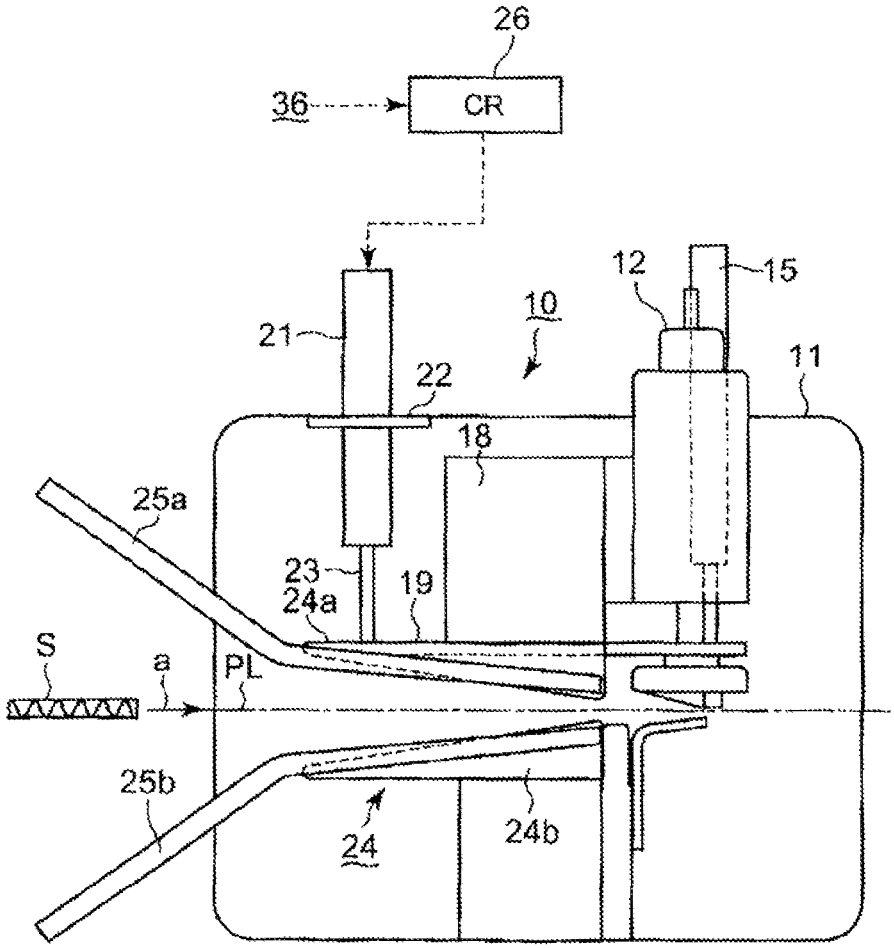
[FIG. 1] A front view of a gluing device in relation to one embodiment of the present invention.
Figure 2:
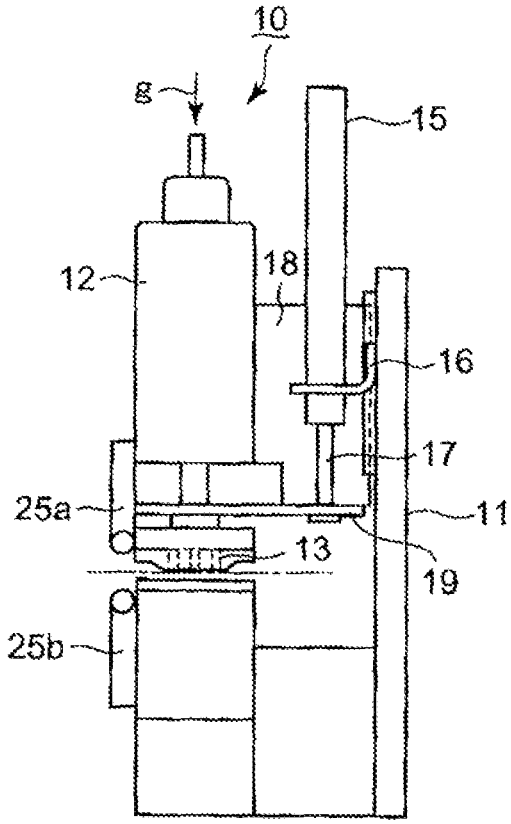
[FIG. 2] A side view of the gluing device in relation to the embodiment.

In reference to FIG. 1 to FIG. 4, one embodiment of the present invention will be explained hereinafter. FIG. 1 is a front view of a gluing device 10 in the box production line of a corrugated board box. FIG. 2 is a side view of the same. In FIG. 1 and FIG. 2, a fixed platen 11 is installed upright facing the transfer line PL of the corrugated board sheet S. A glue gun 12 is vertically arranged above the location at which the gluing margin f of the corrugated board sheet S passes. Glue g is supplied to the glue gun 12 and the glue g is applied from a plurality of nozzles 13 provided at the tip of the glue gun 12 on a gluing area of the gluing margin f of the corrugated board sheet S traveling in the transfer line PL when the nozzles come in contact with the gluing section.

A first air cylinder 15 is fixed in a vertical direction to the fixed platen 11 via a bracket 16. A movable member 18 and a movable platen integrated with the movable member 18 are assembled movable upward and downward in respect with the fixed platen 11. A piston rod 17 of the first air cylinder 15 is installed on the movable member 18 and the movable platen 19. And, the glue gun 12 is fixed to the movable member 18 and the movable platen 19. Thus, the glue gun 12 is made movable upward and downward with the movable member 18 and the movable platen 19.

On an upstream side of the glue gun 12 in the traveling direction of the corrugated board sheet, a second air cylinder is assembled on the vertically fixed to the fixed platen 11 via a bracket 22. A piston rod 23 of the second air cylinder 21 is assembled on an upper guide member 24*a* integral with the movable platen 19. A guide member 24 includes the upper guide plate 24*a* and a lower guide plate 24*b* and the upper and lower guide plates 24*a* and 24*b* are arranged such as to interpose the transfer line PL of the corrugated board sheet therebetween.

The upper and lower guide plates 24 and 24*b* are arranged in the location at which the gluing margin f of the corrugated board sheet S passes, and the distance between the plates 24*a* and 24*b* is made to be smaller toward a downstream side in the traveling direction PL and at the downstream end of the guide member, the guide plates 24*a* and 24*b* are arranged such that the gap therebetween is made slightly smaller than the thickness of the corrugated board sheet S. For instance, when the thickness of the corrugated sheet S is 5.0 mm, the narrowest part between the upper and lower guide plates 24*a* and 24*b* is set 4.8 mm. The upper guide plate 24*a* is movable with the movable platen 29 and the lower guide plate 24*b* is fixed to the fixed platen 11. Thus, when the gluing margin f of the corrugated board sheet S passes through a gap between the upper and lower plates 24*a* and 24*b*, the upper plate 24*a* receives reaction force from the corrugated board sheet S.

Upper and lower guide rods 25*a* and 25*b* are mounted on one end of the upper and lower guide plates respectively so as to guide the corrugated board sheet S onto the transfer line PL. The upper and lower guide rods are arranged to form a taper path by making the distance between the rods smaller toward the downstream side in the same manner as the guide member 24.

Figure 3:
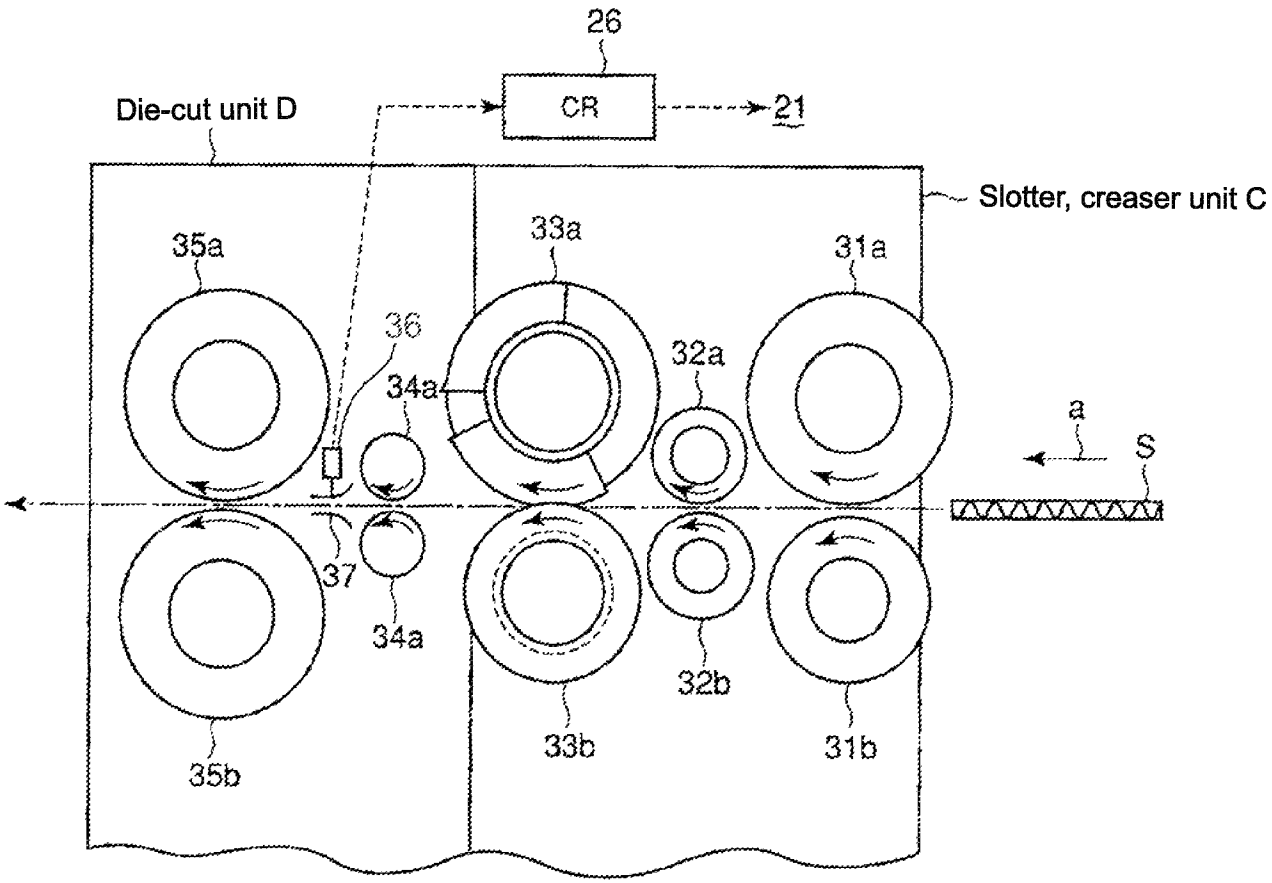
[FIG. 3] A front view of a slotter•creaser and a die-cut unit in relation to the embodiment.

FIG. 3 illustrates a front view of the slotter•creaser C and the die-cut unit D of the box production line. In FIG. 3, the corrugated board sheet S having been introduced into the slotter•creaser C in the direction indicated with an arrow a first passes between upper and lower creaser rolls 31*a* and 31*b* so as to make crease lines thereon. Next, the corrugated sheet S having passed between the upper and lower transferring rolls 32*a* and 32*b* reaches upper and lower slotter 33*a* and 33*b* and passes therebetween so as to form slots on the sheet S.

Subsequently, the corrugated board sheet S is introduced to the die-cut unit D in which the corrugated board sheet S passes between upper and lower transferring rolls 34*a* and 34*b* and then is passed between upper and lower die-cut rolls 35*a* and 35*b* so as to make holes such as handle holes thereon.

In the present embodiment, a reaction-force sensor 36 is provided in the location between the upper and lower rolls 34*a*, 34*b* and the upper and lower die-cut rolls 35*a*, 35*b*. The reaction-force sensor 36 may be a load cell for instance and a guide rail 37 is connected to the reaction-force sensor 36. When the guide rail 37 comes in contact with the corrugated board sheet S, the reaction force of the corrugated board sheet S is transmitted to the reaction-force sensor 36 by which the reaction force is detected.

Specifically, the stiffness of the corrugated board sheet S differs depending on the material and the thickness of the corrugated board sheet also differs depending on the type. The present embodiment determines these differences on the basis of the reaction force detected by the reaction-force sensor 36; and adjusts the stroke of the piston rod 23 of the second air cylinder 21 using the result of the determination so that an optimal pressure for gluing can be applied to the corrugated board sheet S.

With the structure of the present embodiment, the corrugated board sheet S is transferred to the slotter•creaser C and while the corrugated board sheet is formed with the crease lines and slots thereon, the gluing margin f and a join flap of an opposite plane are compressed so as to avoid the gluing parts of the produced box being thick.

Next, the die-cut unit D makes holes on the corrugated board sheet S. The reaction-force sensor 36 arranged between the slotter•creaser C and the die-cut unit D detects the reaction force of the corrugated board sheet S.

A paper type of the corrugated sheet S is informed in advance but the thickness of the corrugated board sheet S may be slightly different depending on the storage duration of the corrugated board sheet having been produced, weather, humidity and temperature during the box producing process and the like. Therefore, the reaction-force sensor 36 detects the reaction force of the corrugated board sheet S and detects the paper type of the corrugated board sheet S and the thickness thereof in the box producing process.

The detection value is inputted to the control unit 26 and the control unit 26 adjust the stroke of the second air cylinder 21 based on the detection value so as to adjust the distance between the upper and lower guide plates 24*a* and 24*b*. In this manner, such optimal pressure is applied that the glue is applied firmly to the gluing margin f of the corrugated board sheet S.

Moreover, the pressure of the second air cylinder 21 may be set in advance based on the detection value of the corrugated board sheets S which have been initially brought in, e.g. in the range of 1 and 10 corrugated board sheets. With this, the initial pressure setting of the second air cylinder 21 is made easier and it is possible to make the pressure of the second air cylinder 21 closer to the optimal pressure in an early stage.

The corrugated board sheet S having been transferred from the die-cut unit D, travels on the transfer line PL in the direction of arrow a and reaches the gluing device 10. So as to compensate the self-weight of the glue gun 12 being applied to the gluing margin f of the corrugated board sheet S when applying the glue, the air cylinder 15 applies the pressure to the glue gun 12 in the direction that compensates the self-weight of the glue gun 12. Ideally, the pressure is applied so that it is near weightless at the point where the glue is applied.

Figure 4:
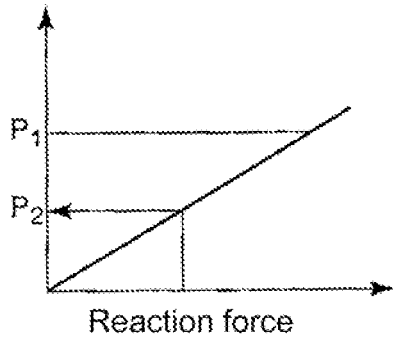
[FIG. 4] A diagram showing pressures being applied by a first air cylinder 15 and a second air cylinder 21 in the embodiment.
Figure 5:
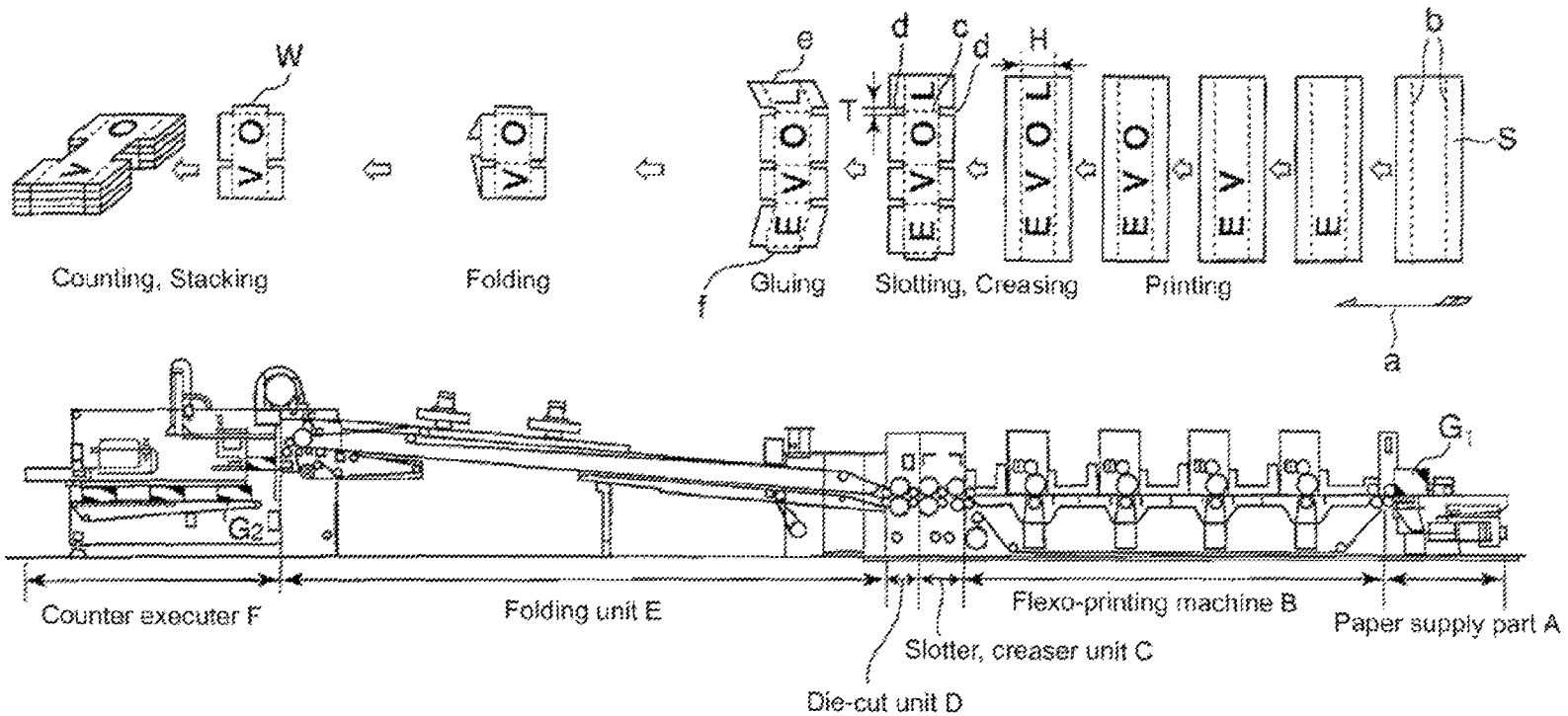
FIG. 5 (Prior Art)
[FIG. 5] A general structure of a box-production line.
Figure 6:
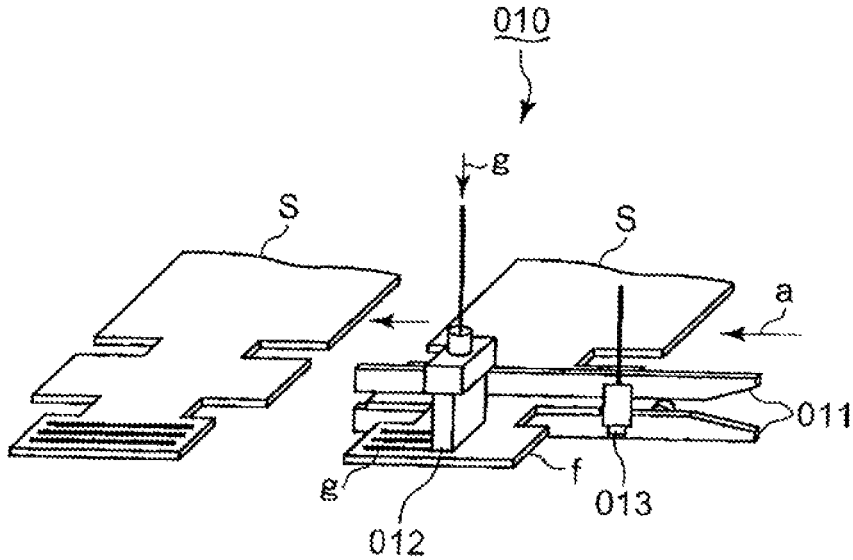
[FIG. 6] A perspective view of a conventional gluing device.

Herein, as shown in FIG. 4, the pressure $P_1$ is the pressure being applied by the first air cylinder 15 so as to compensate the self-weight of the glue gun 12, and the pressure $P_2$ is the pressure being applied to the gluing margin f by the second air cylinder 21 in correspondence with the reaction force detected by the reaction-force sensor 36. As the pressure $P_1$ is greater than the pressure $P_2$, the pressures $P_1$ and $P_2$ are applied by the first and second air cylinders 15 and 21 respectively and thus the optimal pressure can be applied to the gluing margin f during the gluing process.

In this manner, with the present embodiment, while the first air cylinder 15 applies the pressure $P_1$ so as to minimize the contact pressure on the gluing margin f, the second air cylinder 21 applies the pressure $P_2$ which is an optimal pressure depending on the paper type of the corrugated board sheet. Therefore, an optimal amount of the glue can be applied firmly to the gluing margin f without causing tilt or misalignment of the corrugated board sheet S.

Industrial Applicability

According to the present invention, even if the paper type of the corrugated board sheet changes, the gluing can be performed in a stable manner without applying excessive contact pressure on the corrugated board sheet during the process of producing the corrugated board sheet.

The invention claimed is:

1. A gluing method of applying glue, by a contact glue gun, to a gluing area in a gluing margin of a joint flap of a corrugated board sheet transferred on a box production line in a gluing process, the method comprising:

applying pressure to the contact glue gun by a first pressure device in a direction that decreases a self-weight of the contact glue gun against the corrugated board sheet during the gluing process;

detecting a reaction force of the gluing margin by a reaction-force sensor arranged in the box production line downstream of a slotter creaser and upstream of the contact glue gun in a traveling direction of the corrugated board sheet along the box production line, the gluing margin being compressed in the slotter creaser; and applying pressure against the gluing margin of the corrugated board sheet by a second pressure device arranged in a proximity of a gluing point at which the glue is applied by the contact glue gun during the gluing process, the pressure applied by the second pressure device being set in accordance with the reaction force detected by the reaction-force sensor.

2. A gluing device, comprising:

a contact glue gun configured to apply glue, at a gluing point, to a gluing area in a gluing margin of a joint flap of a corrugated board sheet transferred on a box production line;

a first pressure device configured to apply pressure to the contact glue gun in a direction that decreases a self-weight of the contact glue gun;

a reaction-force sensor configured to come in contact with the corrugated board sheet and to detect a reaction force of the gluing margin, the reaction-force sensor being arranged in the box production line downstream of a slotter creaser and upstream of the contact glue gun in a traveling direction of the corrugated board sheet along the box production line, the slotter creaser configured to compress the gluing margin therein; and a second pressure device arranged in a proximity of the gluing point, the second pressure device configured to apply pressure on the gluing margin of the corrugated board sheet when the glue is applied thereto, the pressure to be applied by the second pressure device being set in accordance with the reaction force detected by the reaction force sensor.

3. The gluing device according to claim 2, wherein each of the first and second pressure devices includes an air cylinder.

4. The gluing device according to claim 2, further comprising:

a guide member having a pair of guide plates arranged immediately upstream of the contact glue gun in the traveling direction of the corrugated board sheet along the box production line, wherein the guide plates interpose a transfer path of the corrugated board sheet therebetween so as to form the transfer path into a taper shape, wherein the second pressure device comprises an end terminal connected to one of the guide plates, and wherein the second pressure device is configured to apply the pressure on the gluing margin of the corrugated board sheet via one of the guide plates of the guide member.

* * * * *